United States Patent [19]

Yoshikawa et al.

[11] 4,185,229

[45] Jan. 22, 1980

[54] GAS DISCHARGE PANEL

[75] Inventors: Kazuo Yoshikawa; Shizuo Andoh, both of Kobe, Japan

[73] Assignee: Fujitsu Limited, Japan

[21] Appl. No.: 810,747

[22] Filed: Jun. 28, 1977

[30] Foreign Application Priority Data

Jul. 2, 1976 [JP] Japan ..... 51-79308
Jul. 30, 1976 [JP] Japan ..... 51-91696

[51] Int. Cl.[2] ..... H05B 37/00; H05B 39/00; H05B 41/00

[52] U.S. Cl. ..... 315/169.4; 313/204

[58] Field of Search ..... 313/190, 204, 205, 243, 313/257; 315/169 R, 169 TV

[56] References Cited

U.S. PATENT DOCUMENTS

| | | | |
|---|---|---|---|
| 3,881,129 | 4/1975 | Nakayama et al. | 315/169 TV |
| 3,885,195 | 5/1975 | Amano | 313/190 X |
| 4,005,402 | 1/1977 | Amano | 315/169 TV X |

*Primary Examiner*—Paul L. Gensler
*Assistant Examiner*—Robert E. Wise
*Attorney, Agent, or Firm*—Staas & Halsey

[57] ABSTRACT

A pulse driven self-shift plasma display panel characterized by having meander type shift channels for shifting a discharge spot. Each meander type shift channel is composed of an array of discharge cells defined in the discharge gap at the crossing points of electrodes arranged on parallel substrates, the electrodes on one substrate being oriented generally transversely to those on the other substrate, and barrier structure for determining the meander route being provided. Data in the form of a discharge spot is written in at one end of a shift channel and is shifted by the pulse shift voltages with various phases over the meander route for display at the desired positions. The barrier structure may also be formed using photo-luminescent phosphor material to create desired colored display effects.

26 Claims, 16 Drawing Figures yai = (ya1, ya2, ya3, etc.)

yai = (ya1, ya2, ya3, etc.)

5
6
BR
BR
BR
1
3
4
2 yaj = (ya1, ya2, ya3, etc.)

GAS DISCHARGE PANEL

BACKGROUND OF THE INVENTION

1. Field of the Invention

This invention relates to a gas discharge panel providing a function of shifting or scanning a discharge spot, and especially to an improvement in pulse driven self-shift plasma panels for information display and/or memory.

2. Description of the Prior Art

As an example of a gas discharge display panel, an AC driven plasma display panel having a matrix type electrode arrangement is well known. However, this matrix type plasma display panel has the drawback that a complicated driving circuit is required in order to address individual discharge cells in the discharge gap at the intersection points of electrodes arranged transversely in the horizontal and vertical directions on the two substrates, and the cost of such driving circuits drastically increases with increase in size of the panel. Thus, a "self-shift plasma display" gas discharge panel providing a discharge spot shifting function was developed to simplify the driving circuitry for some applications.

The typical configuration of such self-shift plasma display is described in detail in U.S. Pat. No. 3,944,875, "Gas Discharge Device Having a Function of Shifting Discharge Spots" by Owaki et al, assigned to the same assignee as that of this invention. According to the disclosure of this U.S. Pat. No. 3,944,875, the self-shift plasma display includes common electrodes arranged in the horizontal direction (Y) and coated with a dielectric layer on one substrate, and a plurality of shift electrodes arranged in the vertical direction (X) and also coated with a dielectric layer on the other substrate. The shift electrodes are periodically and sequentially connected to three or more busses and lead out to common terminals, respectively, thereby resulting in the shift channel having a periodic cell arrangement with respect to the common electrodes. Moreover, at one end of the shift channel, the write electrode for inputing the display information is provided. Thus, in such a self-shift plasma display, the discharge spots generated by information input to the write electrode can be shifted sequentially to the adjacent discharge cells by making use of the priming effect due to the plasma couple by sequentially switching the shift voltage via the busses.

However, the above-mentioned self-shift plasma display panel of the crossing electrode type requires that several shift electrodes must be connected sequentially to at least three busses on one substrate. In this connection of the common electrodes to each buss, the crossing area between at least one buss and the shift electrode conductor to be connected to the at least one other buss must be insulated, requiring troublesome crossover techniques. Formation of this crossover area not only impedes yield of panel fabrication and improvement of reliability, but also makes the pitch of the shift electrodes small, significantly hindering realization of high resolution display.

On the other hand, U.S. Pat. No. 3,775,764 to J. P. Gaur entitled "Multi-Line Plasma Shift Register Display", discloses a panel configuration with a different type of self-shift plasma display, wherein several parallel shift electrodes are oppositely arranged in zig-zag at the internal surfaces of a pair of substrates and these shift electrodes are grouped into two groups on each substrate. According to this self-shift plasma display of the parallel electrode type, the drawback accompanying the formation of crossover areas described above is resolved, but a new problem as to discharge spot isolation arises which also impedes high resolution display.

Moreover, other prior art plasma display panels having the function of shifting the discharge spot are described in U.S. Pat. No. 3,704,389 to W. B. McClelland, entitled "Method and Apparatus for Memory and Display." In this prior art, shift electrodes of a special pattern are used in order to shift the discharge spots by making use of the expanding phenomenon of wall charges to the adjacent discharge wall. And, the shift channel is formed by said shift electrodes having a special pattern. However, the self-shift plasma display involved in this prior art is not practical in that plasma coupling between adjacent cells is not considered and therefore it is very difficult to obtain the operating margin required for commercial use.

SUMMARY OF THE INVENTION

The primary object of this invention is a gas discharge panel having a new configuration with a shift or scanning function for the discharge spot.

Another object of this invention is a gas discharge panel having an improved configuration eliminating the necessity of crossover areas between the electrodes and busses.

A further object of this invention is a self-shift plasma display panel suitable for high resolution display.

Still a further object of this invention is a low cost self-shift plasma display panel having a simple configuration and high reliability.

An even further object of this invention is an AC driven plasma display panel having a new configuration with meander type shift channels which can be used similarly to the matrix type display panel.

An additional object of this invention is a self-shift plasma display panel which can easily realized a desired color display using the photo-luminescence of a phosphor material.

Briefly speaking, the gas discharge panel of this invention is characterized by providing a meander type shift channel for the discharge spots.

According to a first embodiment of this invention, said discharge panel includes a pair of substrates, at least two lines of row (Y) electrodes arranged essentially in parallel on one substrate, several column electrodes (X) arranged on the other substrate substantially transversely to said row electrodes (Y); and a discharge gas sealed between said substrates.

The discharge points or discharge cells are defined in the discharge gap between the substrates at the intersections of said row electrodes and column electrodes; and a barrier structure is provided for blocking the plasma coupling from a discharging cell to specific adjacent cells to define the shift channel of the discharge spots along and alternating between said row electrodes, and said shift channel alternating between adjacent discharge cells which utilized in common one row electrode and adjacent discharge cells which utilize in common adjacent row electrodes.

By introducing such barrier structure, a meander type shift channel connecting certain adjacent discharge cells along and between certain adjacent row electrodes can be formed. When such a configuration is employed in matrix type plasma display panels, the information can be shifted between discharge cells of adjacent electrodes along meander type shift channels by alternately driving said row and column electrodes respectively. Moreover, such a configuration can be used as a gas discharge panel for self-shift operation by alternately connecting the row and column electrodes to differently phased busses on each respective substrate, and by providing the write electrode to define the write discharge cell at least at one end of the shift channel.

According to a second embodiment of this invention, the gas discharge panel provides a meander type shift channel composed of the meander type arrangement of discharge cells defined between two or more row electrodes and three or more individually phased column electrodes, at least one of which column electrodes has a meander type pattern that folds back and forth so that each folded section is parallel to the other column electrodes. In other words, such a gas discharge panel includes: at least one meander type column electrode which is arranged to cross at least two row electrodes and which is folded so that each row electrode crossing portion is essentially in parallel with the other column electrodes, defining the first discharge cell group between the meander column electrode and the row electrodes; two groups of parallel column electrodes which are alternately arranged between each parallel section of the folded meander type column electrode to form second and third discharge cell groups alternately between the adjacent discharge cells of the said first discharge cell group; and barriers for restricting discharge of the said discharge cells to define the meander type shift channels.

According to a third embodiment of this invention, the barrier structure for determining the shift channel of the discharge spot may be formed with phosphor material, particularly with a photo-luminescent phosphor material.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
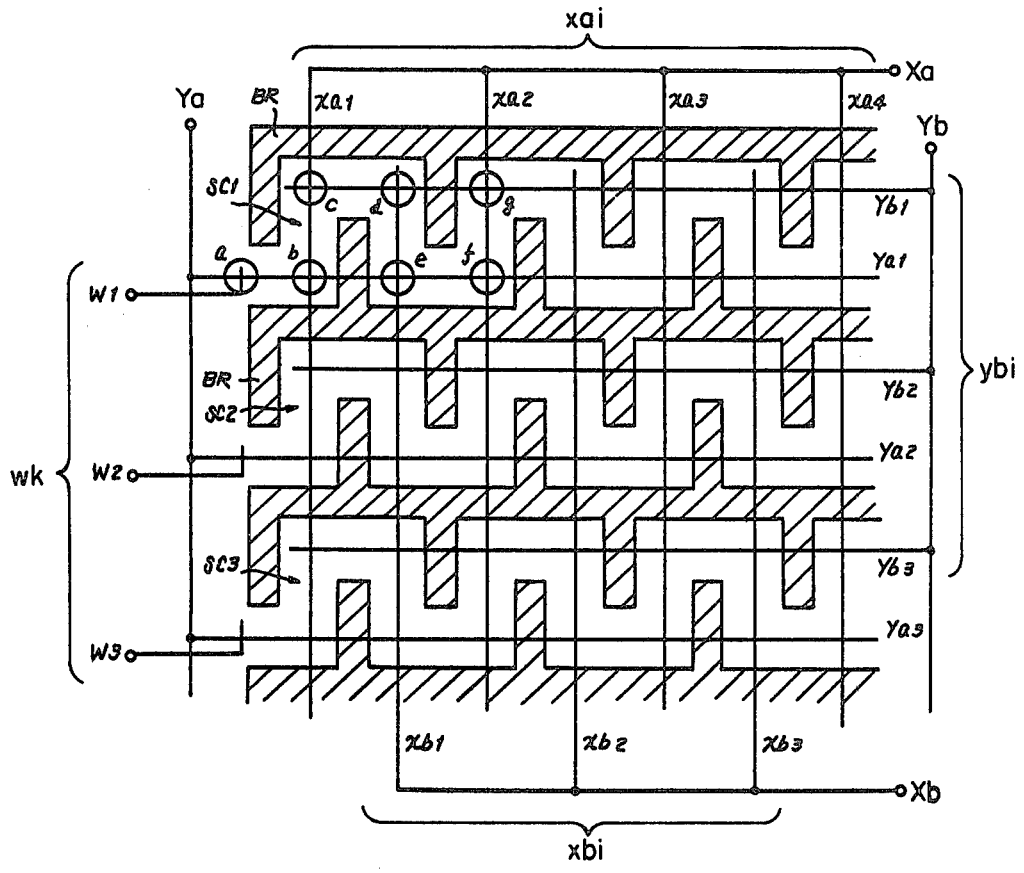
FIG. 1 shows the electrode layout of the first embodiment of the gas discharge panel according to the present invention.

FIG. 1 shows the electrode layout of the first embodiment of the gas discharge panel of this invention. In this figure, Xa, Xb, Ya, Yb are busses; xai, xbi are the $i^{th}$ alternating row electrodes arranged in the Y direction; wk is the $k^{th}$ write electrode; BR is the barrier; and SC1 and SC3 are shift channels or routes.

Figure 2:
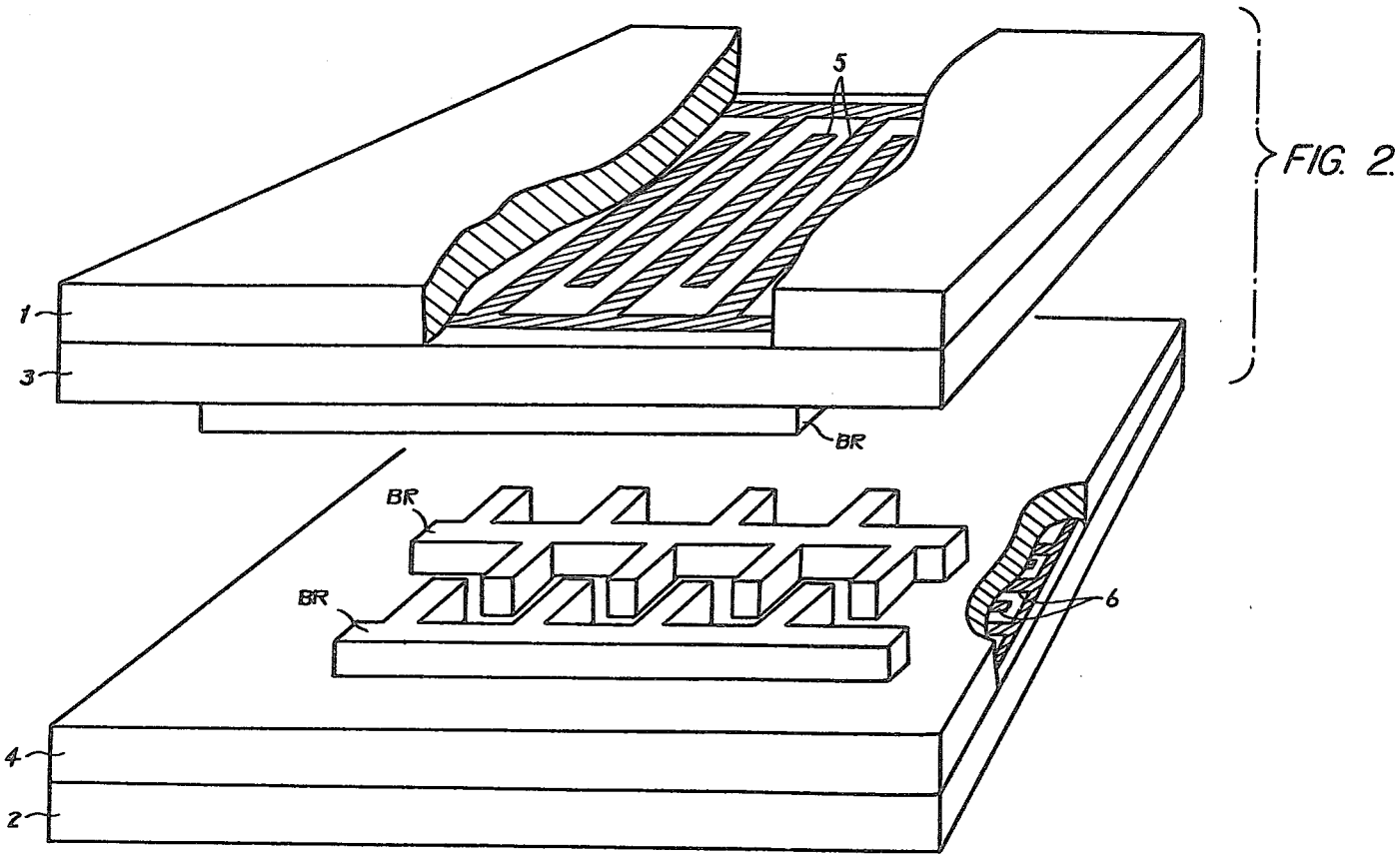
FIG. 2 shows a perspective view, partly broken away, of the major section of the gas discharge panel of the first main embodiment.

FIG. 2 is a partial perspective illustration of the gas discharge panel of this embodiment, wherein: 1, 2 are substrates such as glass; 3, 4 are dielectric layers such as low temperature melting glass; 5, 6 are the above-mentioned X and Y electrodes; BR is a barrier having a wall structure consisting of low temperature melting glass being formed on at least one dielectric layer 4 by, for example, a printing method. If the total number of every other common X electrode xai is Nxa, and if the remaining total number of common X electrodes xbi is Nxb, if the total number of every other common Y electrodes yai is Nya and the total remaining number of common Y electrodes ybi is Nyb, then the total number of discharge cells N can be expressed as $$N=(Nxa+Nxb)\times(Nya+Nyb).$$

Here, Nxa=Nxb, or Nxa=Nxb±1 and Nya=Nyb or Nya=Nyb±1.

The discharge spot generated at the write discharge cell by the $j^{th}$ write electrode wj is shifted in a zig-zag or meander type path along the shift channel formed by said barrier BR over the adjacent two Y electrodes. For example, the discharge spot generated at the discharge site a of the write electrode w1 is shifted in the sequence of the discharge cells, b, c, d, e, f, g, . . . . In the case of static display, display can be made by using only one discharge cell among those in the shift channel.

Figure 3:
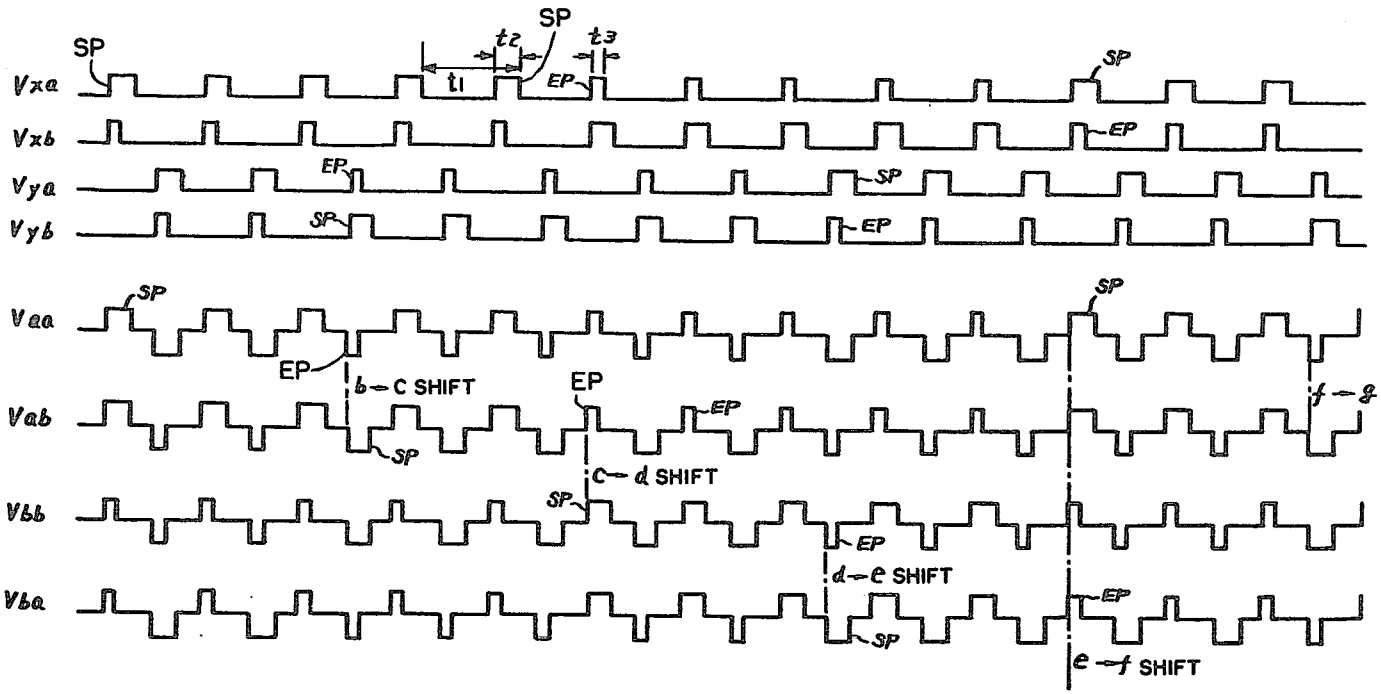
FIG. 3 shows the driving voltage waveforms for shift operation of the panel of FIG. 1.

FIG. 3 shows an example of the driving voltage waveforms. Vxa, Vxb, Vya, Vyb are pulse voltages to be applied to the busses Xa, Xb, Ya and Yb, respectively. The period of pulses, t1, can be set to 15 uS; the pulse width t2 of the shift pulse SP can be set between 5 to 10 uS; and the pulse width t3 of the erase pulse EP can be set between 1 to 2 uS, respectively. The amplitude of the shift pulse Vxh is selected to cause discharge with the help of the priming effect of discharge at an adjacent cell. The amplitude Ve of the erase pulse EP is chosen to stop discharge at or erase a firing cell. Vaa, Vab, Vbb, Vba are the resulting voltage waveforms across the discharge cell at the intersection of the electrodes connected to the busses Xa and Ya, Xa and Yb, Xb and Yb, and Xb and Ya, respectively.

For example, when the write electrode w1 is selected by the input data and the write pulse is applied there and when a discharge spot appears at the discharge site a, the voltage pulse SP of waveform Vaa is applied to the discharge cell b since the shift pulse is applied to the buss Xa at this time, causing the discharge spot to appear also at the discharge site b. Application of waveforms Vxa and Vxb to the busses Xa and Yb, results in the voltage waveform Vab across the discharge cell c. The discharge spot appears at the cell c because of the shift pulse SP in Vab and the erase pulse Ve is applied to the buss Ya to erase—stop the discharge—at cell b. When the shift pulse SP in Vbb is applied to the buss Xb, a discharge begins at cell d. Since the erase pulse Ve is applied at this time to the buss Xa, the discharge at cell c is erased. This is how the discharge spot is shifted as mentioned above.

When the shift operation is performed between adjacent discharge cells having the same row electrode in common, such as from the discharge cell g, to the adjacent discharge site h, to prevent shift of the discharge from g also to the equally distant adjacent cell d also having the same row electrode in common, the barrier BR is provided between alternate adjacent discharge cells along the line of the common row electrode. The barrier prevents the influence of the priming effect due to plasma coupling between the discharge cells g and d. In the embodiment shown in FIG. 1, the barrier BR has a base area in the form of a stripe in order to isolate between shift channels involving different pairs of adjacent Y row electrodes, and this barrier is formed in the pattern of a comb with extensions between alternate adjacent discharge cells from this base area.

The purpose of the barrier BR is to prevent plasma coupling to adjacent discharge cells not in the shift channel. This may also be accomplished by replacing the barrier with a layer of material having a low secondary electron emission coefficient or by use of an electrode to which a field is applied to prevent electrons generated by the discharge to be diffused out of the shift channel. Moreover, it is also possible to realize color display by making use of a phosphor material for this barrier.

Figure 4:
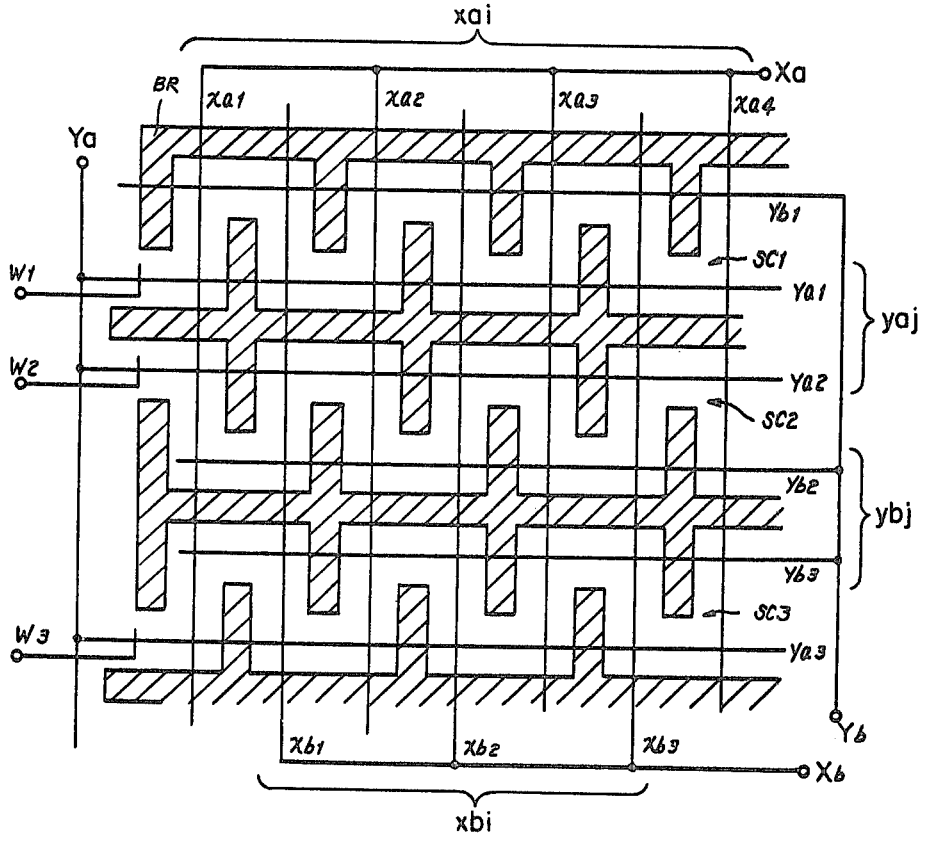
FIG. 4 shows the electrode layout of the second main embodiment.

FIG. 4 shows the electrode layout of the second main embodiment of this invention. In this embodiment, the pattern of barrier BR is different from the embodiment shown in FIG. 1. The Y row electrodes yaj, ybi are arranged and connected alternately at every other two electrodes, instead of every other one.

As is seen from the explanation above, the gas discharge panels of the first and second embodiments can shift the discharge spot over the indicated meander shift channels. The X column electrodes xai, xbi and the Y row electrodes yaj, ybj are respectively connected to the two busses Xa and Xb on the one substrate, and to the other busses Ya and Yb on the other substrate. Since two busses are used on each of both substrates to eliminate the crossover areas, this invention has the advantage of simplifying the manufacturing process.

The conventional self-shift type gas discharge panel having a crossover electrode layout requires three or more busses and therefore if a voltage is applied to only one buss at a time, the other two electrodes yield idle cells between the picture elements of the non-idle discharge spots. However, in the present invention, all the busses may be easily driven simultaneously. This allows high resolution display even with the same electrode density as in the conventional self-shift panel.

Figure 5:
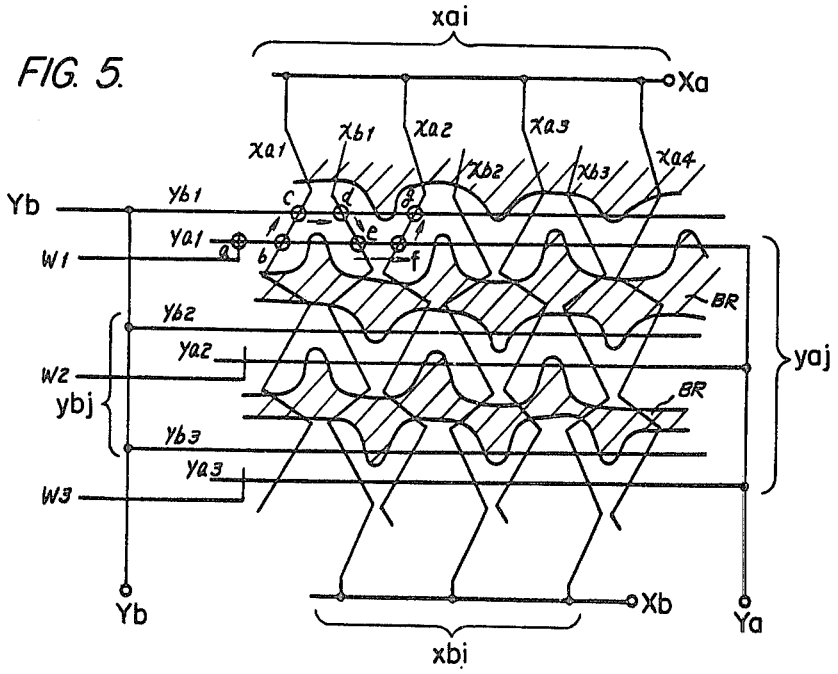
FIGS. 5, 6, 7(A), 7(B) and 7(C) show other modified electrode layouts.

Concerning the first and second main embodiments mentioned above, the electrode layout can be further modified as shown in FIGS. 5, 6 7(A), 7(B) and 7(C). In FIG. 5, the row electrodes yaj, ybj are connected to 2-phase row electrode busses Ya, Yb, and arranged on one substrate in an essentially parallel and linear pattern, and the electrode and substrate surface is coated with a dielectric layer not illustrated. The column electrodes xai, xbi are connected to column electrode busses Xa, Xb in the same way and are arranged on the other substrate with the zig-zag pattern shown, and these electrodes and substrate are also coated with a dielectric layer not illustrated. This zig-zag of the column electrodes as well as the irregular shape of the barrier walls BR results in the discharge cells having unequal distances between adjacent cells. Thus, the shift channel is determined by connecting the adjacent discharge cells with the smallest separations. Thus, a meander type shift channel can be formed over the row electrodes yaj, ybj of two adjacent rows and thereby the discharge spot generated at the write discharge cell a can be shifted in a meander type pattern in the sequence of cells b, c, d, e, f and g. Thus, in this embodiment, the distance between adjacent discharge cells in this shift channel distributed over two row electrodes is nearly constant and is smaller than the distance to adjacent cells not in order in the shift channel as a result of the pattern of said column electrodes.

Therefore, in the embodiment shown in FIG. 5, if the discharge spot is shifted from the discharge cell e to the next discharge cell f, by a shift pulse applied to the buss Xa, the same shift voltage is simultaneously applied to the cell b via the common buss. However, said discharge cell b is more separated from the charge source cell e than is the cell f to which the spot is to be shifted, and therefore a difference of the firing voltages of cells b and f is generated on the basis of the degree of plasma coupling (firing voltage of cell b is higher than that of cell f). Thus, when the amplitude of the shift pulse is set higher than the firing voltage of the next discharge cell—which is adjacent to the charge source cell e, the discharge spot shifts only forward in the direction to cell f and the discharge spot does not shift backward in the shift channel. In this case, the barrier BR could be entirely eliminated, but it is preferred to form a barrier between the more distantly separated, but otherwise adjacent discharge cells in order to guarantee sufficient operating margin. However, as shown in FIG. 5, the required accuracy of the shape of the barrier BR pattern is less than that required for the embodiments shown in FIG. 1 or FIG. 4, which is very convenient for the process of forming the barrier.

Figure 6:
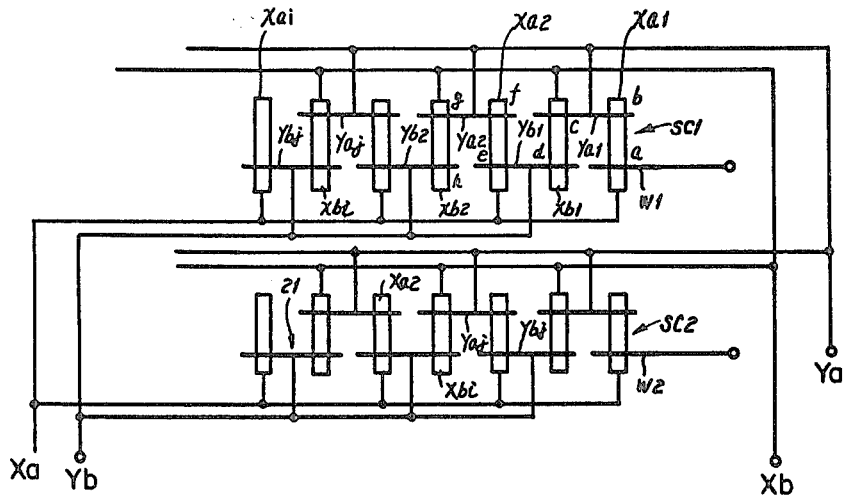

FIG. 6 shows another modification of the electrode arrangement. Two parallel shift channels SC1 and SC2 are indicated. These shift channels each include two groups of column electrodes xai and xbi arranged in parallel at essentially equal intervals on the one substrate and two groups of row electrodes yaj, ybj arranged along two lines crossing with said column electrodes on the other substrate. The column electrode groups xai and xbi are connected alternately to the common busses Xa and Xb and are separately arranged for each shift channel. The row electrodes groups yaj, ybj are connected to the common busses Ya, Yb, respectively. Each row electrode group, such as the Ya electrodes of SC1, is also arranged with the correspondingly adjacent column electrode pair (ya1 crosses xa1 and xb1, etc., and similarly for the Yb group of electrodes for SC1, in that yb1 crosses xb1 and xa2, etc.).

In the electrode layout as shown in FIG. 6, when a certain discharge cell becomes a charge source cell having a discharge spot, a difference of plasma coupling is generated between the adjacent two discharge cells at both sides of said charge source cell, namely, such plasma coupling becomes strong in the cell on the side having the row electrode in common with the charge source cell while it is weaker in the adjacent cell on the side of the charge source cell for which the row electrode is not in common. The discharge spot generally shifts in the electrode extending direction. T. : supply of electrons, ions and metastable atoms from the charge source cell, which is defined as the intensity of plasma coupling or degree of the priming effect, to the adjacent cell having the same row electrode in common exceeds that for the adjacent discharge cell and thereby the firing voltage becomes lower in the former. Thus, by introducing such separate electrode configurations, plasma coupling between adjacent discharge cells in other than the forward-shift direction can be restricted and thereby the shifting direction can be determined as desired. In this case, also, the barrier as shown in FIG. 1 and FIG. 4 may be eliminated, but it is desirable to utilize some such barrier in order to obtain sufficient operating margin.

Figure 7A:
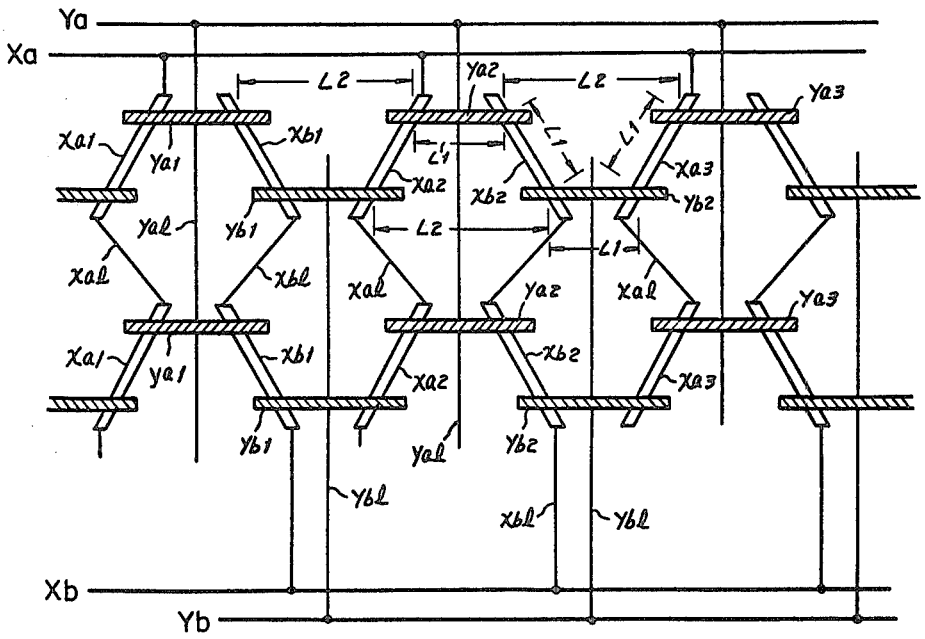
Figure 7B:
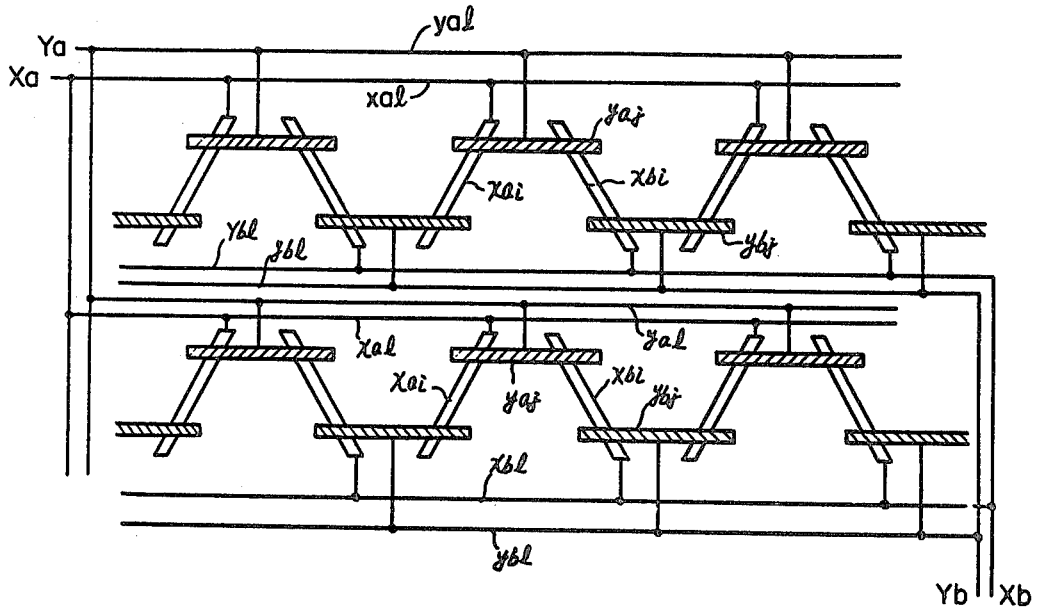
Figure 7C:
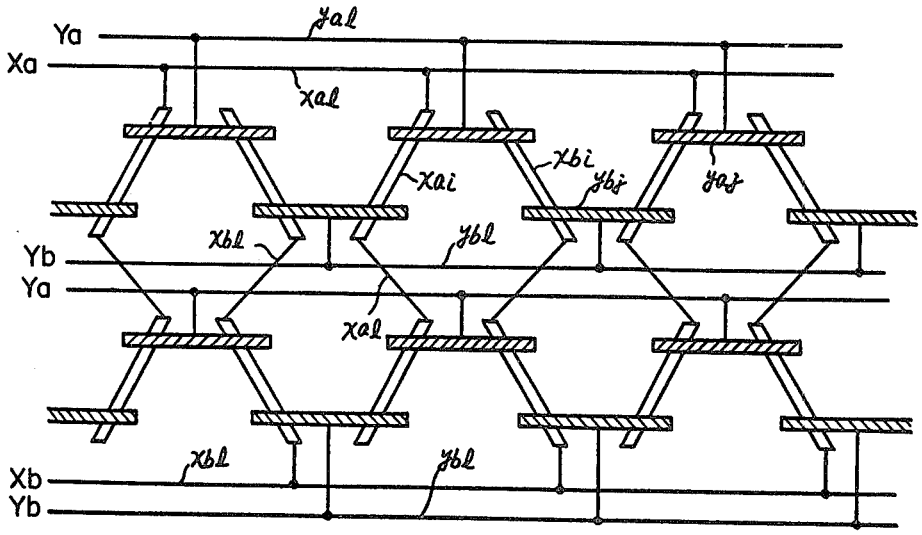

FIGS. 7(A), (B) and (C), respectively, show other modifications of the electrode layout. As is obvious in these embodiments, the electrode layouts combine the electrode patterns shown in FIG. 5 and FIG. 6. The difference between the electrode layouts shown in FIGS. 7(A), (B) and (C) is specifically in the connecting conductor for the busses for grouping these electrodes rather than in the electrode pattern itself. In FIG. 7(A), the electrodes in the same group having the same numbering of each shift channel are connected to the busses in both upper and lower sides via the connecting conductors xal, xbl, and yal, ybl in the vertical direction. In FIG. 7(B), both row and column electrodes are connected to the busses independently in each shift channel by means of the connecting conductors xal, xbl, and yal, ybl in the lateral direction. In the case of the embodiment of FIG. 7(C), the row electrode is independently led out for each shift channel while the column electrode is led out in common for each shift channel. Each of the three kinds of electrode layouts shown in FIGS. 7(A), (B) and (C) gives the meander type shift channel consisting of two lines of row electrode groups yaj, ybj separately arranged for each shift channel, and column electrode groups xai, xbi, obliquely arranged with unequal separation between adjacent discharge cells (e.g., $L_1 < L_2$ in FIG. 7(A), etc.).

The embodiments described above relate to the self-shift plasma display panel having two groups each of row (X) electrodes and column (Y) electrodes, each group of which may be driven by differently phased voltage waveforms referred to as 2×2 phases. The number of phases effects the number of discharge cells along each straight line segment of the meander type shift channel, and can be increased without any cross-over areas.

Figure 8:
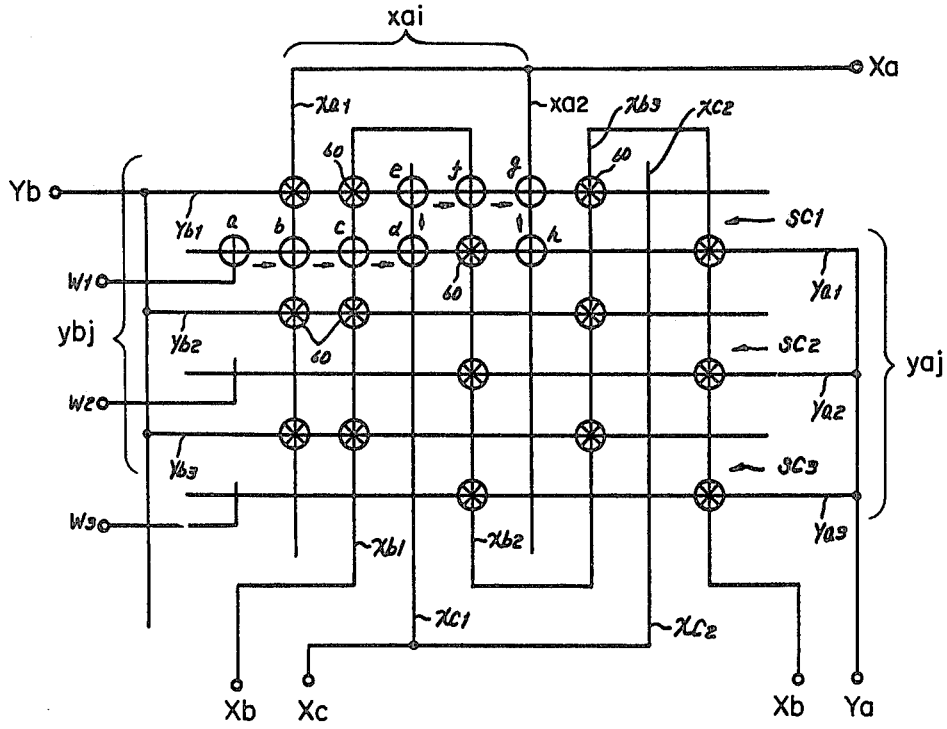
FIG. 8 shows the electrode layout of the third main embodiment having common electrode structure for 2×3 phases.

FIG. 8 shows a self-shift plasma display providing the electrode layout of 2×3 phases as the third main embodiment. In this figure, three meander type shift channels SC1 to SC3 are formed by pairs of electrodes yaj, ybj with two different phases Ya, Yb, and column electrodes xai, xbi, with three different phases Xa, Xb, Xc. The row electrodes yaj, ybj arranged in parallel in the horizontal direction on the one substrate in essentially straight lines are alternately connected to the pair of busses Ya, Yb and are covered with a dielectric layer, not shown. The single phase meander type column electrode provided in the vertical direction on the other substrate is folded into parallel segments xbi and led out to the common terminal Xb. This meander pattern electrode defines a first discharge cell group between it and the row electrodes. In between the segments of the meander type column electrode, the column electrodes xai defining a second discharge cell group with respect to intersections with the row electrodes and the column electrodes xci defining a third discharge cell group in the same way are alternately arranged, and respectively led out to the terminals Xa and Xc via the busses. In addition, the write electrode wj for writing information into each shift channel is provided at one end of each row electrode pair adjacent to the outermost column electrode xal.

Figure 9A:
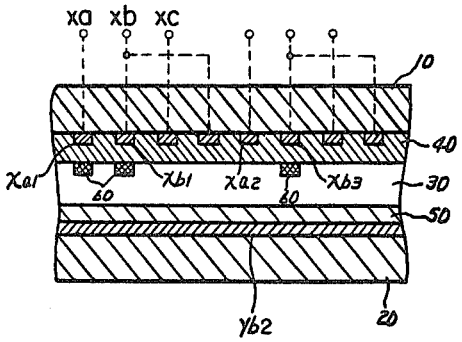
FIGS. 9(A) and 9(B) show sectional views of gas discharge panels having the electrode structure of FIG. 8.

In the embodiment shown in FIG. 8, the discharge restricting means 60 are regularly provided in the pattern shown in the figure for limiting operation to the cells on the meander type shift channel, in the sequence of b, c, d, e, f, g, h, as shown by the small arrow. FIG. 9(A) shows a partial cross-sectional view along the row electrode yb2 showing the preferred embodiment of this discharge restricting means 60. Namely, in FIG. 9(A), this discharge restricting means 60 is shown as a printed barrier consisting of low melting temperature glass formed at the locations corresponding to intersections of electrodes for the purpose of restricting discharge to the dielectric layer covering the column electrodes. For this purpose of restricting discharge, it is also possible to coat the discharge cell wall intersections with a material 60, for example, such as $Al_2O_3$, which has a relatively low secondary electron emission coefficient as compared to the other discharge cell areas. In this case, the pattern to be formed does not require high accuracy because it is only necessary to make the firing voltage of the discharge cells in the shift channel lower than the firing voltage of the other discharge cells, and this depends on the secondary emission coefficient of the surface.

Figure 9B:
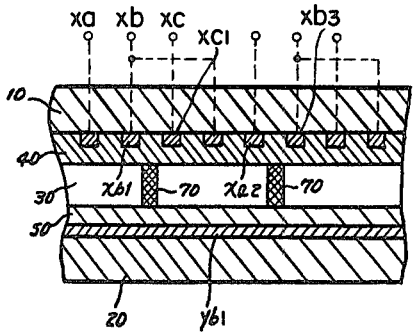

As another embodiment of such discharge restricting means, it is possible to form a wall type barrier 70 as shown in FIG. 9(B) by using low melting temperature glass at the surface of the dielectric layer 40 to limit the plasma coupling to discharge cells in the shift channel. FIG. 9(B) shows, in partial cross-section along the row electrode ybl, the wall barriers which would be required for limiting discharge but which are not actually shown in FIG. 8, that is, between cell d and the cell of SC2 corresponding to cell e of SC1, for isolating the operation of the shift channels. Such wall barriers, as below cells d and h, for isolating shift channels would be necessary even if the barrier embodiment of FIG. 9(A) were employed as shown in FIG. 8. Of course, this shift channel isolation could be provided by simply a line of wall barriers between adjoining row electrodes of adjoining shift channels. In this embodiment, to reduce the degree of coupling for the adjacent discharge cells outside the shift channel, the barrier is formed with thickness corresponding the the gas discharge space as in the case of the conventional barrier. In FIGS. 9(A) and (B), the 10 and 20 are substrates; 30 is the gas discharge space; and 40 and 50 are dielectric layers consisting of low melting temperature glass material. Where, said dielectric layers 40 and 50 are not essential to the self-shift operation, in some cases, it is also possible to use the configuration with DC drive by exposing the electrodes, or any one of the row and column electrodes may be coated with another dielectric layer or a resistance material layer.

According to the gas discharge panel with the configuration of FIG. 8, after the discharge spot is generated at the write discharge cell a by applying the write pulse to the write electrode w1, for example, the discharge spot can be shifted over the meander route in the sequence of the discharge cells b, c, d, e, f, g . . . as indicated by the arrow marks by applying sequentially the shift pulse across the busses (Xa, Ya), (Xb, Ya), (Xc, Ya), (Xc, Yb), (Xb, Yb), (Xa, Yb).

Figure 10:
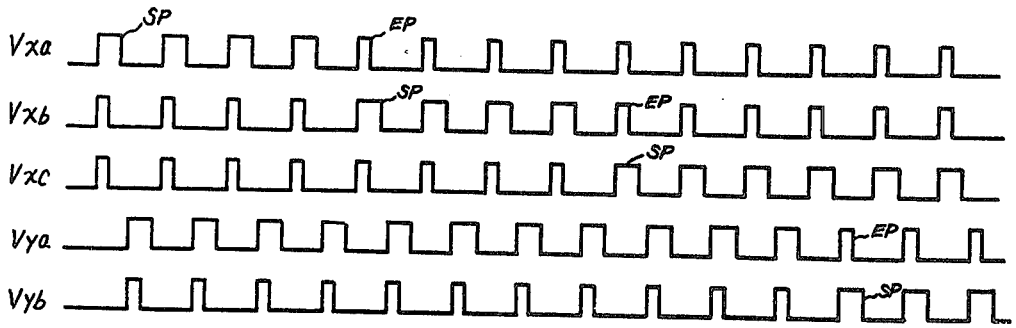
FIG. 10 shows the driving voltage waveforms for shift operation of the panel of FIG. 8.

FIG. 10 shows an example of the driving voltage of 2×3 phases for such self-shift operation. In this figure, Vxa, Vxb, Vxc, Vya and Vyb are pulse trains including the shift pulse SP and erase pulse EP to be applied to each column and row electrode via the busses Xa, Xb, Xc, and Ya, Yb.

Figure 11:
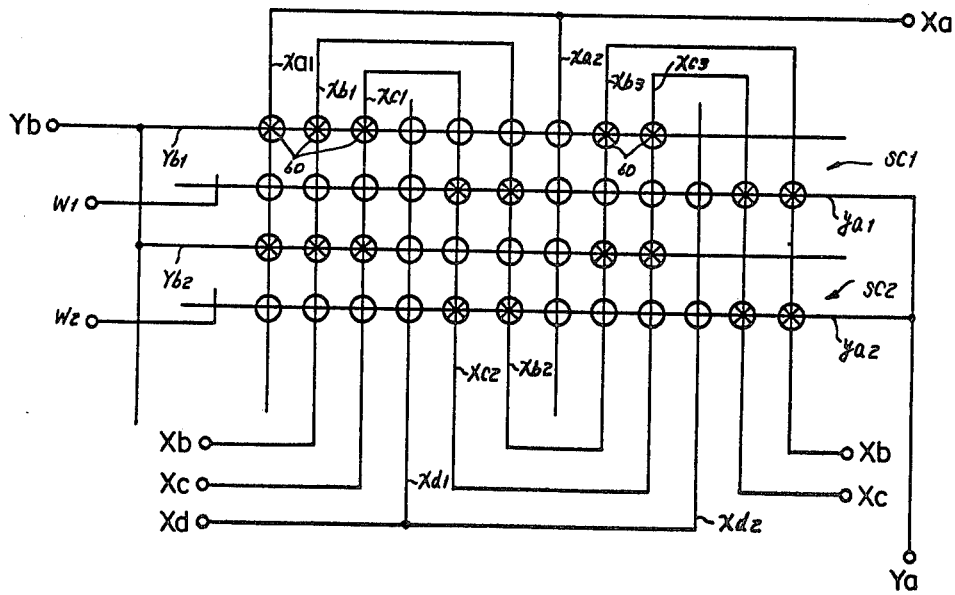
FIG. 11 and FIG. 12 show, respectively, the modified electrode layouts for 2×4 phases and 3×3 phases.
Figure 12:
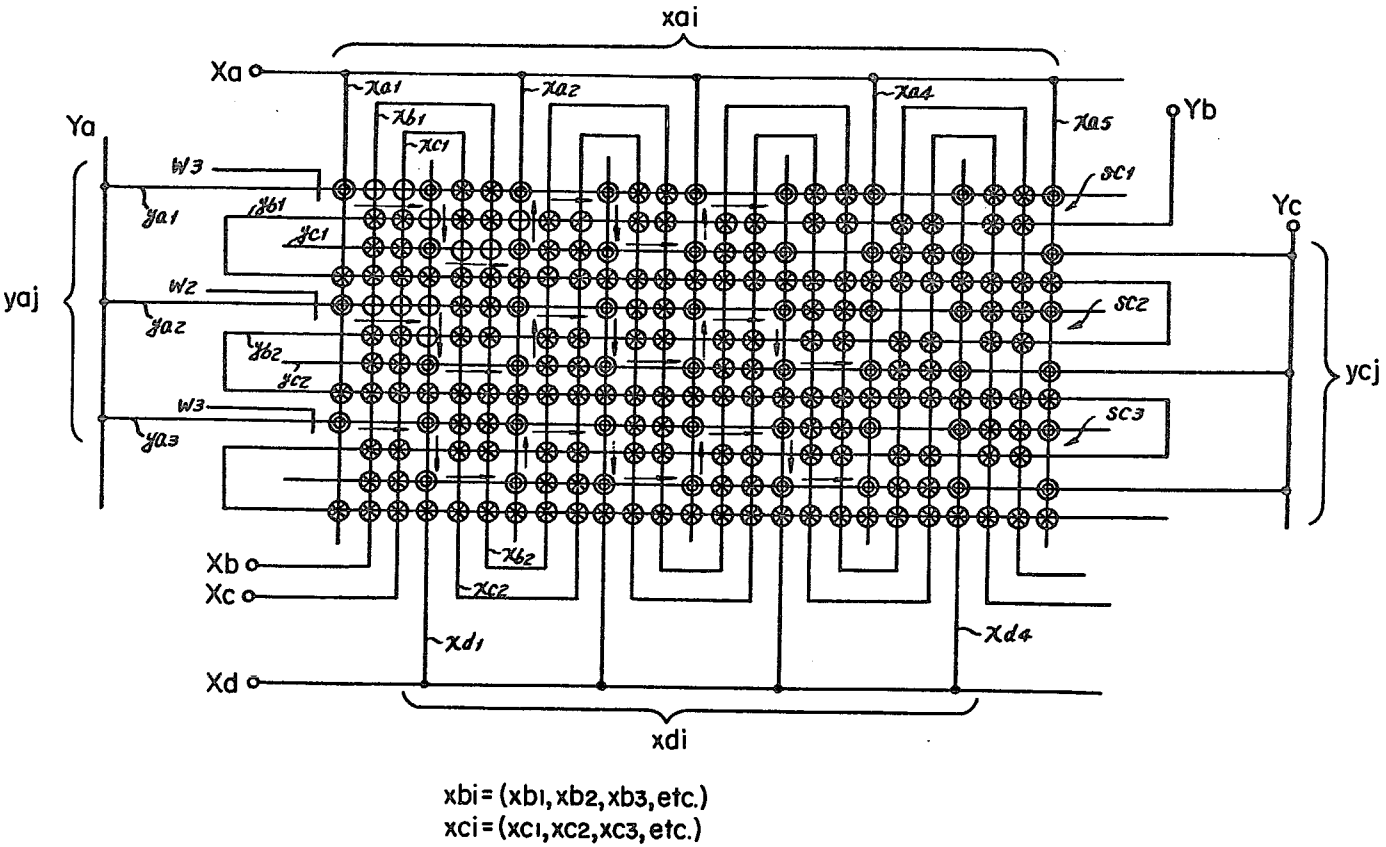

FIG. 11 and FIG. 12 show other embodiments of the self-shift plasma display panel wherein the number of electrode phases is increased without introducing crossover areas. In FIG. 11, two shift channels are formed by 2-phase row electrodes yaj, ybj connected to the terminals Ya, Yb; and 4-phase column electrodes xal, xbl, xcl and xdl connected to the terminals Xa, Xb, Xc and Xd. Again, additional wall barriers (not shown) would be required for isolation of the two shift channels on xd1, xa2 and xd2, a total of three. The segments of the meander column electrodes xbi and xci of the 4-phase column electrodes are respectively connected in common with the meander pattern and the remaining two groups of the column electrodes xai and xbi are arranged alternately in the intervals between the folded electrodes. As in FIG. 8, the discharge cells indicated by the mark (X) are defined to be outside the shift channels by the barrier 60. Therefore, the discharge spot can be sequentially shifted along the cells indicated by the mark O.

In FIG. 12, three shift channels consisting of 3-phase row electrodes yaj, ybj and ycj are connected to the terminals Ya, Yb and Yc; and 4-phase column electrodes xai, xbi, xci and xdi are connected to the terminals Xa, Xb, Xc and Xd. As in the case of FIG. 11, discharge at the discharge cells on the meander electrodes indicated by the mark (X) is prevented. Thus, the discharge spot can sequentially be shifted to the adjacent cells at the discharge cells indicated by the marks O and (O), the latter denoting the corner discharge cells of the meander type shift channels.

The self-shift plasma display having a multi-phase electrode configuration as shown in FIGS. 8, 11 and 12 is inferior in resolution to the panel of 2×2 phases shown in FIG. 1 because the number of electrode phases is increased, but there is less danger of miss-firing since the separation of discharge cells with the same phase is increased. Thereby, a wide operating margin can be obtained. In addition, such multi-phase electrode configuration has the special merit of enhancing production of self-shift plasma displays of large scale easily and with low cost because crossover is not required for leading out the electrodes and accuracy in formation of the barriers is alleviated.

On the other hand, in the plasma display, it is often very useful to obtain color by converting the gas discharge light into photo-luminescent light by utilizing a phosphor material. For incorporation of such a phosphor material, the gas discharge panel of this invention is very useful. Namely, when the barrier BR is formed with a photo-luminescent phosphor material which emits light as a result of excitation by the discharge light, particularly by ultra violet wavelengths, display can be made with the color of light emitted from the phosphor (green). Moreover, in the embodiments shown in FIGS. 8, 11 and 12, by using the phosphor material for the barrier 60 as the discharge restricting means, display color can also be made in the same way. Since the secondary electron emissivity of the phosphor material is generally lower than that of the magnesium oxide (MgO) used as the dielectric layer surface material, the discharge limiting effect will generally be improved.

Figure 13:
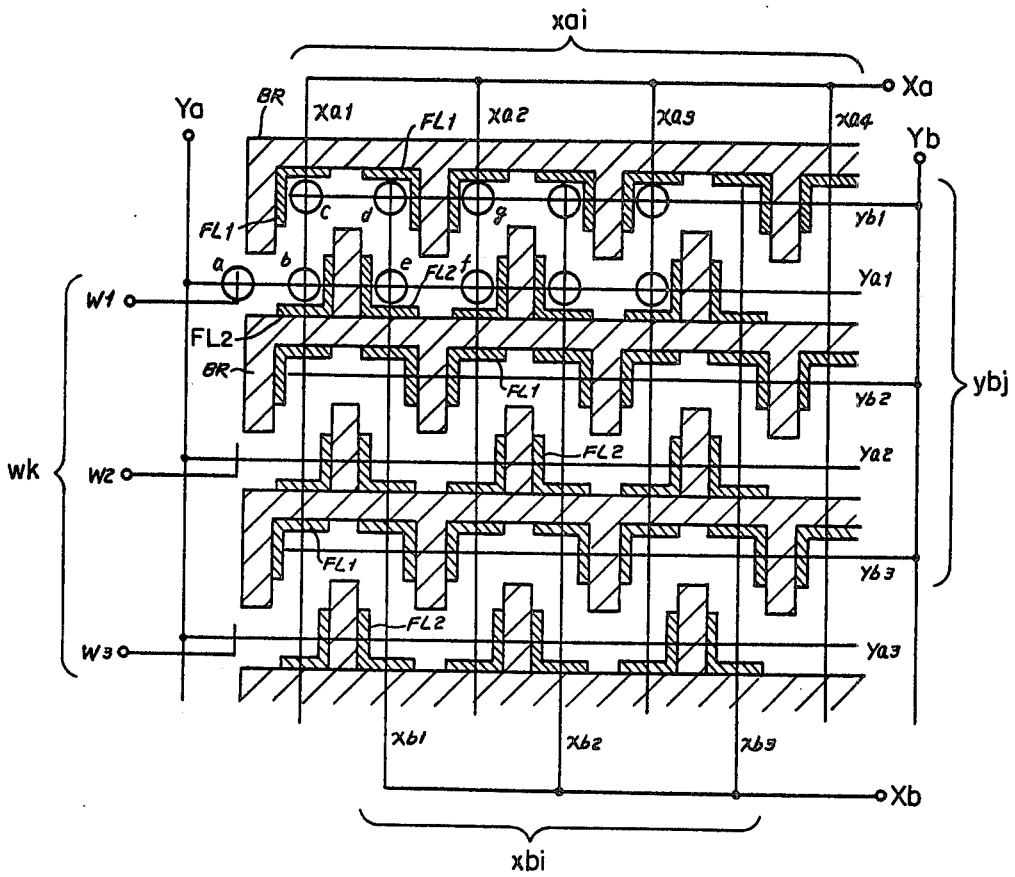
FIG. 13 shows the gas discharge panel of the fourth main embodiment combining a phosphor material.

As the other modifications of the combination of phosphors into the gas discharge panel of this invention, it is possible to introduce such a configuration as shown in FIG. 13. In FIG. 13, at least two kinds of phosphors FL1 and FL2 are combined and these are formed at the side walls of the barrier BR. At the side wall of the barrier BR along the row electrodes yaj of each shift channel, a red phosphor material FL2 may be provided while at the opposite side wall of the barrier along the other row electrodes ybj, the green phosphor material FL1 may be provided. Therefore, after the written discharge spot is shifted to the desired position, it is fixed or sustained at the discharge cell on the row electrode yaj. Thereby, the red phosphor material FL2 is excited resulting in display in red. When the discharge spot is fixed or sustained at the discharge cell on the row electrode ybj, the green phosphor material FL1 is excited resulting in display in green. Namely, by selecting the row electrode for the display, the display color can be changed. In the display mode, the discharge spot can be kept at the vertically or horizontally disposed position adjacent two discharge cells and therefore display color can also be changed by using phosphor materials of different color to be combined for each column electrode group and by selecting two groups of electrodes. In addition, by defining the discharge cell for fixing the discharge spots and by combining four kinds of phosphors for each group of 4-phase discharge cells, four kinds of display colors can be selected.

As is obvious from the above description, the gas discharge panel of this invention is easy to produce with low cost and high reliability since the shift channels are formed without crossover areas. In addition, wider operating margins can be obtained since shifting is restricted to the shift channels by the barriers. Moreover, it is convenient for combining phosphor materials and suitable for diversified display purposes.

The above description has been made for the preferred embodiments of the present invention. Various modifications and combinations, such as application in DC discharge type gas discharge panels, can be realized easily by skilled workers in the art.

We claim:

1. A gas discharge panel having a plurality of meander patterned shift channels, each said shift channel comprising a periodic sequence of adjacent discharge cells, each said discharge cell being defined between respective first and second electrodes on respective substrates and separated by a gas discharge space, said discharge cells of each said shift channel comprising a periodic arrangement of said electrodes on said respective substrates, said electrodes on each said substrate being selectively connected in common by buses arranged on each said respective substrate to define said periodic arrangement of discharge cells of each said meander patterned shift channel, said arrangement of said buses on each said substrate comprising means for making said selective common connection of the respective ones of said electrodes on each said substrate without any one of said buses and said common connection means on each said substrate crossing over any other of said buses and said common connection means on the same one of said substrates, and said panel comprising means for selectively coupling a discharge between adjacent ones of said discharge cells along each of said shift channels.

2. The panel of claim 1, said means for selectively coupling said discharge between adjacent ones of said discharge cell along each of said shift channels comprising barrier means in contact with at least one of said substrates and located to prevent said coupling between adjacent pairs of said discharge cells except for selected ones of said adjacent pairs of said cells the line between which coincides with a segment of one of said meander patterned shift channels.

3. The panel of claim 2, said barrier means comprising electric insulator means located in said discharge gap at selected ones of said discharge cells not comprising said shift channels.

4. The panel of claim 2, said barrier means comprising electric insulator means located in said discharge gap between selected pairs of said discharge cells.

5. The panel of claim 2, said barrier means comprising phosphor means for displaying at least one color when said phosphor means is adjacent to at least one of said discharge cells comprised within one of said shift channels.

6. The panel of claim 1, said means for said selective coupling comprising said periodic arrangement for said electrodes being such that adjacent pairs of said discharge cells a line between which does not coincide with a segment of one of said meander patterned shift channels are separated by a greater distance than said adjacent pairs of discharge cells a line between which coincides with a segment of one of said shift channels.

7. The panel of claim 1, said means for said selective coupling between selected adjacent pairs of said discharge cells comprising one respective electrode on one of said substrates extending in common between both said discharge cells of each one of said selected adjacent pairs.

8. The panel of claim 1, at least one of said substrates having a dielectric layer covering said buses and said electrodes on said at least one substrate, and said means for said selective coupling between adjacent pairs of said discharge cells comprising portions of different secondary electron emissivity at the surface of said at least one dielectric layer.

9. The panel of claim 1, said selective common connection of said electrodes on said substrates comprising two of said buses on each one of said substrates being arranged in parallel and separated by at least one of said shift channels, each of said two parallel buses comprising conductive projections extending toward the other of said two parallel buses, said projections from one of said two parallel buses periodically alternating with said projections from the second of said two parallel buses, said two pairs of buses and alternating projections having a pattern of two parallel but opposing combs with intermeshing teeth.

10. The panel of claim 9 comprising at least a third bus on at least one of said substrates, said third bus being connected to a meander patterned electrode that meanders, with parallel segments between fold back portions, between said alternately extending projections of said two buses on said at least one substrate.

11. The panel of claim 10 comprising one of said meander patterned electrodes on one of said substrates, barrier means located selectively at discharge cells adjacent to, but which are not comprised within, said shift channels, and additional barrier means located between adjacent discharge cells comprised within different shift channels, each said shift channel comprising a periodic sequence of discharge cells along two adjoining ones of said alternately extending projections on the substrate not having said meander patterned electrode, each unit period of said periodic sequence comprising a first three sequential discharge cells along the direction of said shift channels followed by a second three discharge cells along said same direction but displaced from said first three cells by one cell in the direction transverse to said same direction, the last of said first three cells lying in said transverse direction from the first of said second three cells.

12. The panel of claim 10 comprising two of said meander patterned electrodes on one of said substrates, barrier means located selectively at discharge cells adjacent to, but not comprised within, said shift channels, and additional barrier means located between adjacent discharge cells comprised within different shift channels, each said shift channel comprising a periodic sequence of discharge cells along two adjoining ones of said alternately extending portions on the substrate not having said meander patterned electrodes, each unit period of said periodic sequence of said shift channels comprising the unit period of a first four sequential discharge cells along the direction of said shift channels followed by a second four cells along said same direction but displaced from said first four cells by one cell in the direction transverse to said same direction, the last of said first four cells lying in said transverse direction from the first of said second four cells.

13. The panel of claim 10 comprising at least one of said meander patterned electrodes on each said substrate.

14. The panel of claim 9, periodic adjacent pairs of said projections from said buses being separated by a respective one of said shift channels, and said adjacent projections comprising further conducting projections alternately extending selectively toward a respective one of said shift channels from said adjacent projections for providing said selective common connection of said electrodes defining said periodic shift channels.

15. A gas discharge panel comprising two substrates separated by a gas discharge space, one bus arranged along each of two opposing sides of each substrate on the side thereof facing said discharge gap, said two buses on said sides of each substrate being parallel to each other and transverse to said two buses on the other one of said substrates, electrodes extending from each of said buses in the direction of said bus on the opposing side of the same said substrate, said electrodes extending from said buses on each substrate periodically and alternating with the electrodes extending from the other of said buses on the same said substrate, the crossing points of said electrodes on one of said substrates with those on the other of said substrates defining a periodic arrangement of discharge cells, and said buses and electrodes on each substrate not having any crossovers on the same substrate, and barrier means in said discharge space for defining a plurality of shift channels extending in the same direction of said buses on one of said substrates, said barrier means comprising linear portions extending in between alternating abjacent pairs of said electrodes on said one substrate, and extensions from said linear portions alternately extending between alternating pairs of said discharge cells adjacent to each of said linear portions on each side of each said shift channels to define a periodic meander pattern for said shift channels.

16. The panel of claim 15 comprising phosphor means at least at selected parts of said barrier means for displaying at least one preselected color when those of said discharge cells of said shift channels adjacent said selected parts are discharged.

17. The panel of claim 15, said periodic alternating of said electrodes extending from said buses comprising the period of one electrode extending from each of said buses on opposing sides of at least one of said substrates.

18. The panel of claim 17, said electrodes alternately extending from said buses parallel to said shift channels being periodically inclined to increase the spacing between adjacent pairs of said discharge cells between which said extensions from said barrier means extend.

19. The panel of claim 15, said periodic alternating of said electrodes extending from said opposite sides of said substrates comprising the period of a first adjacent pair of electrodes extending from one of said buses followed by a second adjacent pair of electrodes extending from the other of said buses on said opposite sides of at least one of said substrates.

20. The panel of claims 15, 16, 17, 19, or 18 comprising a dielectric layer selectively covering said electrodes and buses on at least one of said substrates.

21. A gas discharge panel comprising two insulating substrates separated by a discharge gap, a plurality of meander patterned shift channels aligned along a first direction between said substrate, each said shift channel comprising a periodic array of discharge cells, each said discharge cell comprising a respective pair of opposing electrodes mounted on said substrates and separated by said discharge space, one of said electrodes of each said discharge cell extending to comprise in common one of said electrodes of an adjacent discharge cell, said commonly extending electrodes on one of said substrates being oriented in said first direction and said commonly extending electrodes on the other of said substrates being oriented transversely to said first direction, every pair of adjacent discharge cells of each of said shift channels having one of said electrodes in common to both discharge cells of said pair, a bus oriented transversely to said first direction at the two opposing sides of each of said substrates, adjacent the ends of each of said shift channels, and an extension from each of said buses along said first direction along each of said shift channels to connect said electrodes to said buses, said electrodes, buses and extensions from buses on each said substrate being arranged without any crossover thereof on each said substrate.

22. A gas discharge panel comprising a plurality of meander patterned shift channels aligned side by side along a first direction, each said shift channel comprising a sequence of adjacent discharge cells, each said discharge cell comprising an electrode on each of two substrates and separated by a discharge gap, each adjacent pair of said discharge cells along each of said shift channels comprising one of said electrodes extending in common to both cells of said pair, said commonly extending electrodes of each said shift channel on a first one of said substrates being aligned along said first direction and side by side with, but spaced from, a corresponding common electrode of each adjacent shift channel, and said commonly extending electrodes on the other of said substrates being aligned along, and with inclination to, a plurality of lines transverse to said first direction, said inclination of said electrodes on said other substrate being sufficient to selectively increase the separation between selected pairs of said discharge cells of each said shift channel which do not have one of said commonly extending electrodes in common to both cells of said pair, a bus arranged on each of two opposing sides of each of said substrates, and means for selectively connecting said buses to said electrodes of said shift channels, said buses, said electrodes and said means for said connection thereof on each said substrate comprising an arrangement for no crossover thereof.

23. The panel of claim 22, said buses being aligned along said first direction, and said means for connecting said electrodes and said buses at the sides of each said substrate comprising bus extensions extending transversely to said first direction, said bus extensions on said first substrate extending alternately from each of said buses toward the other of said buses on opposing sides of said first substrate to connect corresponding ones of said electrodes of said side by side plurality of shift channels aligned in said first direction, and each of said bus extensions on the other said substrate also alternately extending from each of said buses toward the other of said buses on opposing sides of said other substrate to connect respective ones of said inclined electrodes of said plurality of side by side shift channels.

24. The panel of claim 22, said buses being aligned transversely to said first direction, and each of said commonly extending electrodes being connected to one of said buses by a bus extension from each said bus for each said shift channel, each said bus extension being arranged in said first direction and adjacent to the respective one of said shift channels.

25. The panel of claim 22, said buses on said first substrate being aligned transverse to said first direction and said means for connecting said buses on said first substrate to said electrodes comprising bus extensions alternately extending from buses on said first substrate along said first direction between each adjacent pair of said side by side shift channels to respectively connect corresponding ones of said commonly extending electrodes of each shift channel, said buses on the other of said substrates being aligned along said first direction and said means for connecting said buses and electrodes on said other substrate comprising bus extensions extending transversely to said first direction from each of said buses on opposing sides of said other substrate toward the other one of said buses, each of said bus extensions extending alternately and periodically to connect corresponding ones of said electrodes of said side by side shift channels.

26. The panel of claim 22 comprising an insulating layer selectively covering said buses, connecting means, and electrodes on at least one of said substrates.

* * * * *

UNITED STATES PATENT AND TRADEMARK OFFICE

CERTIFICATE OF CORRECTION

PATENT NO. : 4,185,229

DATED : January 22, 1980

INVENTOR(S) : Kazuo Yoshikawa et al.

It is certified that error appears in the above—identified patent and that said Letters Patent is hereby corrected as shown below:

Col. 1, line 42, "inputing" should be --inputting--;
Col. 1, line 53, "buss" should be --bus--;
Col. 1, line 54, "buss" should be --bus--;
Col. 1, line 55, "buss" should be --bus--;
Col. 2, line 40, "realized" should be --realize--;
Col. 4, line 60, "buss" should be --bus--;
Col. 4, line 66, "buss" should be --bus--;
Col. 4, line 67, "buss" should be --bus--;
Col. 5, line 49, "buss" should be --bus--;
Col. 6, line 17, "buss" should be --bus--;
Col. 6, line 19, "buss" should be --bus--;
Col. 9, line 41, "miss-firing" should be --misfiring--.

Signed and Sealed this

*Twenty-ninth* Day of *July 1980*

[SEAL]

*Attest:*

SIDNEY A. DIAMOND

*Attesting Officer*

*Commissioner of Patents and Trademarks*